United States Patent [19]

Inoue et al.

[11] 4,340,658

[45] Jul. 20, 1982

[54] LAMINATED ZNO PHOTOSENSITIVE MATERIAL

[75] Inventors: Eiichi Inoue, Tokyo; Isamu Shimizu, Yokohama, both of Japan

[73] Assignee: Mita Industrial Co., Ltd., Osaka, Japan

[21] Appl. No.: 240,403

[22] Filed: Mar. 4, 1981

[30] Foreign Application Priority Data

Mar. 8, 1980 [JP] Japan ..... 55-28584

[51] Int. Cl.[3] ..... G03G 5/087; G03G 5/14

[52] U.S. Cl. ..... 430/58; 430/57; 430/65; 430/88

[58] Field of Search ..... 430/57, 58, 65, 88

[56] References Cited

U.S. PATENT DOCUMENTS

| | | | |
|---|---|---|---|
| 2,987,395 | 6/1961 | Jarvis | 430/57 |
| 3,801,317 | 4/1974 | Tanaka et al. | 430/57 |
| 3,861,796 | 1/1975 | Tanaka et al. | 430/58 X |
| 3,881,923 | 5/1975 | Tanaka et al. | 430/57 X |
| 4,076,528 | 2/1978 | Bean et al. | 430/88 |

FOREIGN PATENT DOCUMENTS

| | | | |
|---|---|---|---|
| 49-35700 | 9/1974 | Japan | 430/57 |

*Primary Examiner*—Roland E. Martin, Jr.
*Attorney, Agent, or Firm*—Sherman & Shalloway

[57] ABSTRACT

Disclosed is a laminated photosensitive material for electrophotography, which comprises a conductive substrate, an undercoat layer formed of a composition comprising a resin binder having no substantial photoconductivity and photoconductive zinc oxide in an amount of 1 to 20 parts by weight per part by weight of the resin binder, an intermediate layer formed of a composition comprising a polyvinyl carbazole type photoconductor and photoconductive zinc oxide in an amount of 1 to 20 parts by weight per part by weight of the photoconductor and a topcoat layer comprised of a polyvinyl carbazole type photoconductor.

This laminated photosensitive material has a very high sensitivity and a high initial charge voltage in combination and provides an image having a high density and a high contrast.

4 Claims, 1 Drawing Figure

LAMINATED ZNO PHOTOSENSITIVE MATERIAL

BACKGROUND OF THE INVENTION (1) Field of the Invention

The present invention relates to a laminated photosensitive material for electrophotography. More particularly, the present invention relates to a laminated photosensitive material for electrophotography, which has a very high sensitivity and a high initial charge voltage in combination.

(2) Description of the Prior Art

An organic polymeric photoconductor such as polyvinyl carbazole has properties suitable for formation of photosensitive layers, such as high transparency, good flexibility and good film-forming property, but this photoconductor is not satisfactorily used in the field of commercial electrophotographic reproduction because the sensitivity is low.

As means for improving the sensitivity, there has already been proposed a method in which polyvinyl carbazole (often referred to as "PVK" hereinafter) is used as a material of a laminated photosensitive plate. As a typical instance of such proposal, there can be mentioned a method an undercoat layer of a composition comprising polyvinyl carbazole and photoconductive zinc oxide is formed on a conductive substrate and a topcoat layer of polyvinyl carbazole is formed on this undercoat layer.

A laminated photosensitive plate prepared according to this method has a sensitivity higher than that of a photosensitive plate of PVK alone or a photosensitive plate formed of a composition of PVK and zinc oxide. However, this laminated photosensitive plate is still insufficient in attainment of the object of forming an image having a high density and a high contrast. More specifically, at the step of charging by corona discharge or the like, the surface saturation voltage of this laminated photosensitive plate is about 200 V at highest, and therefore, it is very difficult to form an electrostatic latent image having a high density and a high contrast.

SUMMARY OF THE INVENTION

We found that if an undercoat layer comprising a resin binder and zinc oxide at a specific ratio and an intermediate layer comprising PVK and zinc oxide at a specific ratio are interposed between a PVK photosensitive layer and a conductive substrate, the saturation charge surface voltage of the resulting photosensitive plate can be improved to an especially high level and also the sensitivity can remarkably be improved.

We have now completed the present invention based on this finding.

More specifically, in accordance with the present invention, there is provided a laminated photosensitive material for electrophotography, which comprises a conductive substrate, an undercoat layer formed of a composition comprising a resin binder having no substantial photoconductivity and photoconductive zinc oxide in an about of 1 to 20 parts by weight per part by weight of said binder, an intermediate layer formed of a composition comprising a polyvinyl carbazole type photoconductor and photoconductive zinc oxide in an amount of 1 to 20 parts by weight per part by weight of said photoconductor and a topcoat layer formed of a polyvinyl carbazole type photoconductor.

BRIEF DESCRIPTION OF THE DRAWING

The FIGURE is a sectional view illustrating a laminated photosensitive plate according to the present invention.

In the drawing, reference numerals 1, 2, 3 and 4 represent a conductive substrate, an undercoat layer, an intermediate layer and a topcoat layer, respectively.

DETAILED DESCRIPTION OF THE PREFERRED EMBODIMENTS

Figure 1:
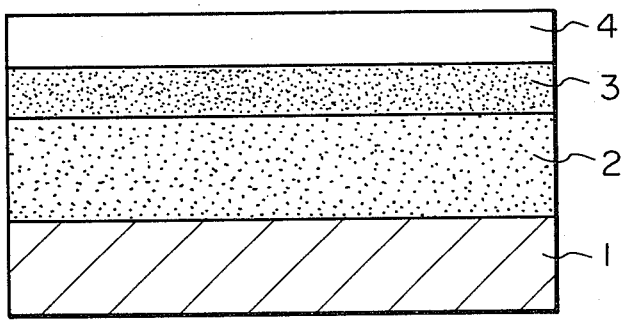

Referring to the FIGURE, the laminated photosensitive plate of the present invention comprises a conductive substrate 1, an undercoat layer 2 of zinc oxide-binder formed on the substrate 1, an intermediate layer 3 of zinc oxide-PVK formed on the undercoat layer 2 and a topcoat layer 4 of PVK formed on the intermediate layer 3.

One of important features of the present invention is that an undercoat layer 2 of zinc oxide-binder and an intermediate layer 3 of zinc oxide-PVK are disposed in combination below the PVK surface layer 4. The PVK photosensitive layer alone has a high saturation charge surface voltage, but as pointed out hereinbefore, if this photosensitive layer is combined with a zinc oxide-PVK photosensitive layer or a zinc oxide-binder photosensitive layer, drastic drop of the saturation charge surface voltage is observed. In contrast, if the undercoat layer 2 of zinc oxide-binder and the intermediate layer 3 of zinc oxide-PVK are interposed between the PVK surface layer 4 and the conductive substrate 1 according to the present invention, as illustrated in the Example given hereinafter, the saturation charge surface voltage is increased to a level at least two times, especially at least 3 times, as high as the saturation charge surface voltage attainable in the above-mentioned two-layer photosensitive plate, and simultaneously, the sensitivity is improved to the order of several lux-sec.

In the photosensitive plate of the present invention having the above-mentioned structure, the zinc oxide-PVK intermediate layer 3 acts as a carrier (charge) generating layer at the exposure step, while the PVK surface layer 4 acts as a charge transporting layer. In this point, the photosensitive plate of the present invention is not different from the known laminated photosensitive plate. However, the laminated photosensitive plate of the present invention is distinguishable over the known laminated photosensitive plate in the point where the zinc oxide-binder undercoat layer 2 acts as a blocking layer at the step of charging the surface of the photosensitive layer.

In the present invention, it is important that in this undercoat layer, a resin having no substantial photoconductivity should be used as the binder and zinc oxide should be combined with this binder in an amount of 1 to 20 parts by weight, preferably 4 to 10 parts by weight, especially preferably 5 to 7 parts by weight, per part by weight of the binder. Dispersion of zinc oxide in such specific amount into the above-mentioned resin binder results in increase of the saturation charge surface voltage and prominent improvement of the sensitivity.

In the present invention, it is also important that in the intermediate layer of the photosensitive plate, a polyvinyl carbazole type photoconductor should be used as the binder and zinc oxide should be combined with this binder in an amount of 1 to 20 parts by weight, preferably 2 to 10 parts by weight, especially preferably 5 to 8 parts by weight, per part by weight of the binder. If the above-mentioned amount of zinc oxide is combined with PVK in the intermediate layer, the initial saturation surface voltage is increased and the sensitivity is remarkably enhanced.

It is known that the sensitivity of photoconductive zinc oxide is influenced by the size of zinc oxide particles, and it is admitted that in case of a photosensitive layer comprising photoconductive zinc oxide dispersed in a resin binder, the larger is the particle size of zinc oxide, the higher is the sensitivity. In the present invention, as photoconductive zinc oxide that is used in combination with the resin binder or PVK, there may be used not only zinc oxide having such a coarse particle size but also zinc oxide having a fine particle size. In the present invention, however, it has been found that zinc oxide having a fine particle size, especially a number average particle size of 0.2 to 2 $\mu$m as measured by an electron microscope, is likely to provide satisfactory results with respect to the sensitivity and initial saturation surface voltage.

A laminated photosensitive plate prepared by using untreated zinc oxide as zinc oxide has an excellent sensitivity to rays of the ultraviolet region.

It has been found, however, that if only a dye sensitizer is adsorbed and held on particles of photoconductive zinc oxide to be dispersed in a polyvinyl carbazole type photoconductor for the intermediate layer, a photosensitive plate having an excellent sensitivity to rays of the visible region can be obtained. In this case, it is very important that the dye sensitizer should be absorbed and held on the particles of zinc oxide, and it should be understood that if zinc oxide and dye sensitizer are merely dispersed in the polyvinyl carbazole type photoconductor, a photosensitive plate having a good sensitivity to visible rays cannot be obtained at all.

For making the dye sensitizer adsorbed on zinc oxide particles, there may preferably be adopted a method in which the dye is dissolved in an appropriate solvent such as water or methanol, the solution is sufficiently contacted with zinc oxide particles to make the dye adsorbed on the zinc oxide particles and the solvent is distilled or evaporated.

As the dye sensitizer, there can be mentioned, for example, phthalein dyes such as fluoresceine, eosine and Rose Bengale, basic dyes such as Malachite Green, Methyl Green and Brilliant Green, cyanine dyes such as cryptocyanine and pure cyanol, phenolsulfone phthalein dyes such as Phenol Red and Bromophenol Blue, octahalogenophenolsulfone phthalein dyes such as octabromophenolsulfone phthalein and octaiodophenolsulfone phthalein, and sulfone fluoresceine dyes. These dyes may be used singly or in the form of a mixture of two or more of them. The dye sensitizer is used in an amount of 0.05 to 1 part by weight, especially 0.1 to 0.4 part by weight, per 100 parts by weight of photoconductive zinc oxide.

Known polymer binders, especially electrically insulating binders, may be used as the binder for the undercoat layer in the present invention. For example, there can be mentioned acrylic resins such as polyacrylic acid esters, polymethacrylic acid esters, acrylic acid/methacrylic acid ester copolymers, acrylic acid/styrene copolymers and maleic acid anhydride/styrene/methacrylic acid ester copolymers, vinyl aromatic polymers such as polystyrene and polymethylstyrene, vinyl chloride resins such as vinyl chloride/vinyl acetate copolymers, partially saponified vinyl chloride/vinyl acetate copolymers, partially saponified and acetalized vinyl chloride/vinyl acetate copolymers and vinyl chloride/vinyl acetate/maleic acid anhydride copolymers, butadiene copolymers such as styrene/butadiene copolymers and acrylonitrile/styrene/butadiene copolymers, olefin resins such as ethylene/vinyl acetate copolymers, ethylene/acrylic acid copolymers and ionomers, polyester resins such as ethylene/butyleneterephthalate/isophthalate copolymers, polyamide and copolyamide resins, polycarbonates, alkyd resins, unsaturated polyester resins, urethane resins such as acrylic urethane resins, epoxy resins, phenol-formaldehyde resins, urea-formaldehyde resins, xylene resins, and melamine-formaldehyde resins. These binders may be used singly or in the form of a mixture of two or more of them. It is preferred that the binder should have an electric resistance (volume resistivity) of at least $1\times10^{11}$ $\Omega$-cm.

As the polyvinylcarbazole type photoconductor that is used for the surface layer or intermediate layer, there can be mentioned not only PVK but also poly-N-arylcarbazole, poly-N-propenylcarbazole, poly-N-(2-p-vinylbenzoylethyl)carbazole, poly-N-acrylcarbazole, and nuclear substitution products thereof having such a substituent as a nitro group, a halogen atom, a methyl group, an ethyl group or the like. The molecular weight of the polyvinyl carbazole that is used in the present invention is not particularly critical, so far as it has a film-forming property.

In order to improve the adhesion of the surface layer or intermediate layer or increase the mechanical strength of the photosensitive layer per se, a binder having no photoconductivity may be used in combination with the PVK type photoconductor. As such binder, there can be mentioned, for example, a polyester resin, an epoxy resin, a polycarbonate resin, a polyurethane resin, a xylene resin, an acrylic resin and a styrene-butadiene copolymer. This binder is used in an amount of 0.1 to 50 parts by weight, especially 10 to 30 parts by weight, per 100 parts by weight of the PVK type photoconductor.

In order to improve the surface smoothness of the photosensitive layer, a levelling agent such as polydimethylsiloxane may be used in an amount of 0.005 to 5 parts by weight per 100 parts by weight of the PVK type photoconductor.

As the conductive substrate, there may be used a sheet or drum formed of a foil or plate of a metal such as aluminum, copper, tin or tinplate. Furthermore, there may be used a sheet formed by applying such metal on a substrate of a film such as a biaxially drawn polyester film or a glass sheet by such means as vacuum deposition, sputtering or non-electrode plating, or a Nesa glass.

The photosensitive plate of the present invention can easily be prepared by forming an undercoat layer composition comprising a dispersion of zinc oxide in an organic solvent solution of a polymeric binder, an intermediate layer composition comprising a dispersion of zinc oxide in an organic solvent solution of a PVK type photoconductor and a topcoat layer composition comprising a solution of a PVK type photoconductor in an organic solvent, and coating and baking these compositions on a conductive substrate in due order.

From the viewpoint of electrophotographic characteristics of the resulting photosensitive plate, it is important to select the resin binder of the undercoat layer and the solvent of the intermediate layer composition so that the resin binder of the undercoat layer formed in advance is not dissolved again by the solvent of the intermediate layer composition. From this viewpoint, it is preferred that a vinyl chloride/vinyl acetate/ethylenically unsaturated carboxylic acid or its anhydride copolymer be used as the binder of the undercoat layer and a chlorobenzene/toluene mixed solvent be used as the solvent for PVK.

In the laminated photosensitive plate of the present invention, there is observed a tendency that as the thickness of the undercoat layer (blocking layer) is increased, both the initial surface voltage and the sensitivity are improved. Accordingly, it is preferred that the thickness of the undercoat layer be at least 2μ, particularly at least 10μ and especially particularly 12 to 30μ. On the other hand, increase of the thickness of the intermediate layer (carrier generating layer) tends to result in reduction of the initial surface voltage and the sensitivity. Accordingly, it is preferred that the thickness of the intermediate layer be smaller than 10μ and especially 0.1 to 2μ. If the thickness of the surface layer (charge transporting layer) is at least 0.5μ, satisfactory initial surface voltage and sensitivity can be obtained, and especially good results are obtained if the thickness of the surface layer is 1 to 3μ.

The present invention will now be described in detail with reference to the following Example that by no means limits the scope of the invention.

EXAMPLE

Influences of the amounts of zinc oxide added to the blocking layer and to the charge generating layer were examined while the amount of zinc oxide added to the charge transporting layer was kept constant.

At first, influences of the proportion of the binder resin and zinc oxide in the blocking layer were examined. Coating compositions for formation of the blocking layer were prepared by adding 0, 1, 2.5, 5, 7.5 or 10 g of zinc oxide (SOX-500 manufactured and supplied by Seido Kagaku Kogyo K. K.) to 10 g of a 10% solution of a binder resin (Slec M, vinyl chloride/vinyl acetate/maleic acid copolymer manufactured and supplied by Sekisui Kagaku Kogyo K. K.) in tetrahydrofuran. Tetrahydrofuran was further added as a solvent in an appropriate amount into each composition. Then, the mixture was dispersed for 1 minute by an ultrasonic disperser. The resulting composition was coated on a hard Al substrate having a thickness of 50μ so that the thickness of the coating layer was 10μ after drying, and the coated substrate was dried at 100° C. for 20 minutes to form a blocking layer.

Separately, 10 g of zinc oxide (SOX-500), 30 mg of Rose Bengale as a dye and 40 g of methanol as a solvent were sufficiently stirred to make the dye adsorbed on zinc oxide. The dye-adsorbed zinc oxide was dried and pulverized at 80° C. for 24 hours. Then, 5 g of this dye-adsorbed zinc oxide was dispersed in 4 g of toluene and 6 g of monochlorobenzene by an ultrasonic disperser, and 10 g of a 10% solution of PVK in monochlorobenzene was added to the dispersion and the mixture was dispersed again by an ultrasonic disperser. Then, the so formed composition was coated on the above blocking layer so that the thickness of the coating layer was about 1μ after drying, and the applied composition was dried at 100° C. for 10 minutes to form a charge generating layer.

Then, a solution of 1 g of PVK in 8 g of monochlorobenzene and 9 g of toluene was uniformly coated on the charge generating layer so that the thickness of the coating layer was about 2μ after drying, and the coated solution was dried at 100° C. for 20 minutes to form a charge transporting layer.

The so obtained photosensitive plate was allowed to stand in the dark place for 24 hours, and the charging characteristics were measured by using an electrostatic copying paper tester (Model SP-428 manufactured and supplied by Kawaguchi Denki K. K.). The applied voltage was −6 KV and exposure was carried out under 10 luxes by using a tunsten lamp. The obtained results are shown in Table 1. In Table 1, the initial voltage means the surface voltage just before exposure, and the half-value exposure quantity is a product of the time (seconds) required for the initial surface voltage to be reduced to ½ and the illuminance (luxes).

TABLE 1

Influences of Amount of Zinc Oxide in Blocking Layer on Charging Characteristics

| Amount (g) of Zinc Oxide per Gram of Resin | Initial Voltage (V) | Half-Value Exposure Quantity (lux-sec) |
|---|---|---|
| 0 | 325 | 45 |
| 1.0 | 350 | 40 |
| 2.5 | 420 | 20 |
| 5.0 | 530 | 10 |
| 7.5 | 515 | 8 |
| 10.0 | 460 | 6 |

From the results shown in Table 1, it is seen that the photosensitivity was increased as the amount of zinc oxide added to the binder was increased and the initial surface voltage was highest when 5 g of zinc oxide was added per gram of the binder.

Influences of the proportion of PVK and zinc oxide in the charge generating layer on the charging characteristics were then examined.

The blocking layer was formed in the same manner as described above by using 5 g of zinc oxide per gram of the resin binder. Then, 1, 2.5, 5, 7.5 or 10 g of the above-mentioned dye-adsorbed zinc oxide was added to 10 g of a 10% solution of PVK in monochlorobenzene, and a charge generating layer was formed in the same manner as described above by using the so prepared composition. The dispersing and coating conditions were the same as described above. Then, a charge transporting layer was formed under the same conditions as described above. The resulting photosensitive plate was tested in the same manner as described above to obtain the results shown in Table 2.

TABLE 2

Influences of Amount of Dye-Adsorbed Zinc oxide in Charge Generating Layer on Charging Characteristics

| Amount (g) of Zinc Oxide per Gram of PVK | Initial Voltage (V) | Half-Value Exposure Quantity (lux . sec) |
|---|---|---|
| 1.0 | 545 | 19.0 |
| 2.5 | 590 | 8.5 |
| 5.0 | 620 | 6.5 |
| 7.5 | 620 | 7.0 |
| 10.0 | 580 | 7.0 |

From the results shown in Table 2, it is seen that if 2.5 g of dye-adsorbed zinc oxide was added per gram of PVK, that sensitivity was abruptly improved and the initial surface voltage was highest when 5 to 7.5 g of dye-adsorbed zinc oxide was added per gram of PVK.

From the foregoing results, it will readily be understood that especially good results are obtained when the amount of zinc oxide is 4 to 10 g per gram of the binder in the blocking layer and that especially good results are obtained when the amount of dye-adsorbed zinc oxide is 2 to 10 g per gram of PVK in the charge generating layer.

For comparison, a photosensitive plate comprising a charge generating layer and a charge transporting layer but being free of a blocking layer was prepared and tested in the same manner as described above to obtain the results shown in Table 3.

TABLE 3

Influences of Amount of Dye-Adsorbed Zinc Oxide in Charge Generating Layer in Two-Layer Structure on Charging Characteristics

| Amount (g) of Zinc Oxide per Gram of PVK | Initial Voltage (V) | Half-Value Exposure Quantity (lux . sec) |
|---|---|---|
| 1.0 | 170 | 160 |
| 2.5 | 140 | 56 |
| 5.0 | 145 | 28 |
| 7.5 | 125 | 24 |
| 10.0 | 100 | 28 |

From the results shown in Table 3, it will readily be understood that if the blocking layer is not formed, the initial surface voltage is low and the photosensitivity is drastically reduced.

What we claim is:

1. A laminated photosensitive material for electrophotography, which comprises a conductive substrate, an undercoat layer formed of a composition comprising a resin binder having no substantial photoconductivity and photoconductive zinc oxide in an amount of 1 to 20 parts by weight per part by weight of said binder, an intermediate layer formed of a composition comprising a polyvinyl carbazole type photoconductor and photoconductive zinc oxide in an amount of 1 to 20 parts by weight per part by weight of said photoconductor and a topcoat layer comprised of a polyvinyl carbazole type photoconductor.

2. A laminated photosensitive material as set forth in claim 1, wherein the photoconductive zinc oxide in the intermediate layer consists of particles of photoconductive zinc oxide having a dye sensitizer adsorbed thereon and has an enhanced sensitivity to rays of the visible regions.

3. A laminated photosensitive material as set forth in claim 2, wherein said dye sensitizer is present in an amount of 0.05 to 1 part by weight per 100 parts by weight of the photoconductive zinc oxide.

4. A laminated photosensitive material as set forth in claim 1, wherein the thickness of the undercoat layer is at least $2\mu$ and the thickness of the intermediate layer is smaller than $10\mu$.

* * * * *